United States Patent [19]

McCullough et al.

[11] Patent Number: 4,992,164

[45] Date of Patent: Feb. 12, 1991

[54] METHOD OF CHARGE NEUTRALIZATION USING CHELANTS

[75] Inventors: T. Miles McCullough, Houston; James G. Edmondson, Conroe, both of Tex.; Joseph J. Perugini, Ohain, Belgium

[73] Assignee: Betz Laboratories, Inc., Trevose, Pa.

[21] Appl. No.: 487,362

[22] Filed: Mar. 1, 1990

[51] Int. Cl.[5] ..... C10G 1/00

[52] U.S. Cl. ..... 208/282; 208/177; 208/47; 208/348; 208/265; 208/284

[58] Field of Search ..... 208/47, 348, 265, 282, 208/284, 289

[56] References Cited

U.S. PATENT DOCUMENTS

| | | | |
|---|---|---|---|
| 2,913,406 | 11/1959 | Hoover | 208/257 |
| 3,033,781 | 5/1962 | Hoover | 208/288 |
| 3,272,736 | 9/1966 | Petro et al. | 208/348 |
| 3,819,328 | 6/1974 | Go | 21/2.5 R |
| 4,514,281 | 4/1985 | Baumert et al. | 208/47 |
| 4,898,684 | 2/1990 | Parker et al. | 252/389.62 |

*Primary Examiner*—Helane Myers

*Attorney, Agent, or Firm*—Alexander D. Ricci; Gregory M. Hill

[57] ABSTRACT

A method of neutralizing chloride ions present in a hydrocarbon medium during processing in a petroleum refinery. Nitrilotriacetic acid or its salt form is injected into the crude charge upstream of the preheat unit. Chloride levels are reduced in this way without the deleterious effects which result from treatment with the conventionally used NaOH.

2 Claims, No Drawings

METHOD OF CHARGE NEUTRALIZATION USING CHELANTS

FIELD OF INVENTION

The present invention relates to the processing of crude oil in a petroleum refining operation. Particular attention is focused on the removal of corrosive contaminants from the oil.

BACKGROUND OF THE INVENTION

Crude oil is processed through petroleum refineries in order to separate the various hydrocarbon products from each other in the crude. Much of this processing takes place at elevated temperatures which reach as high as 700° F in the distillation columns.

Raw crude oil contains corrosive elements which cannot be removed in the field. Of primary importance is brine which characteristically makes up from about 0.2 to 2.0 percent of the incoming raw crude. Brine contains chloride salts, primarily the magnesium, calcium and sodium varieties thereof.

The desalting operation removes a significant amount of these impurities. However, small amounts of the chloride salts remain with the desalted crude as it is charged into the distillation unit.

During the elevated temperature processing of the crude charge in the distillation unit, the chloride salts, primarily $MgCl_2$, are hydrolyzed via the following reaction:

$$MgCl_2 \overset{H_2O}{\rightleftharpoons} Mg(OH)_2 \downarrow + 2HCl \uparrow$$

HCl is then carried overhead in the fractionation towers. Since it is a highly corrosive acid, the HCl will attack and corrode the metallic surfaces throughout the fractionation unit and the upper regions of the distillation columns. The HCl can also combine with volatile basic materials, such as $NH_3$, to form corrosive salt deposits on tower internals.

Corrosive destruction of and deposition onto these metallic components require corrective action in the form of costly and time consuming repairs. This is detrimental to the cost effective operation of the entire refinery.

A commonly used method to control the evolution of HCl involves the addition of NaOH. This is generally done by injecting an aqueous solution of NaOH into the desalted crude oil charge line. The function of the NaOH is to react with the readily hydrolyzable salts to form NaCl and the corresponding hydroxide. NaCl is much more resistant to hydrothermal decomposition than, for example, $MgCl_2$. This results in the generation of less HCl.

NaOH is an effective inhibitor of HCl evolution, but its use is accompanied by various negative factors. The choice of this treatment program to reduce chloride concentrations requires the use of large excesses of NaOH. There are two primary reasons for this. First, NaOH is a strong base which will react with acidic species present in all crude oils to various degrees. These acidic species include carboxylic acids, including naphthenic acids, and $H_2S$. The second reason for the requirement of large quantities of NaOH is due to its poor dispersibility in crude oil which renders it functionally less efficient.

Excessive amounts of NaOH cause further problems for the refinery operator. NaOH results in caustic cracking and embrittlement near the feed point and causes increased deposition of excess caustic, $Mg(OH)_2$, $CaCO_3$, etc. in the crude preheat section. Additionally, the practice, described above, produces an increased concentration of $Na^+$ in the bottoms products which necessitates further processing or results in the production of a lower grade end product. Furthermore, higher $Na^+$ content of bottoms products causes an increased rate of poisoning of downstream catalytic units. These negative factors are significant economic disincentives militating against the use of NaOH. If NaOH were not used, however, increased corrosion and deposition would result.

PRIOR ART

Beyond the traditional, well-known approach of inhibiting the evolution of HCl by use of NaOH, other methods have been developed.

These primarily require the addition of specific amine or ammonia compounds.

U.S. Patents 2,913,406 and 3,033,781, both to Hoover, disclose corrosion inhibiting compounds blended from copper compounds such as copper carbonate, ammonia and sodium or ammonium bicarbonate. These complex compounds are intended to react with and neutralize the acidic species present in the crude oil.

Petro et al., U.S. Patent 3,272,736, combine the teachings of Hoover with a modification of conventional treatment programs. They disclose a process in which ammonium carbonate and either sodium hydroxide or potassium hydroxide, or mixtures thereof, are added to the crude oil prior to elevated temperature processing.

Japanese patent 49-38902 discloses the use of amine compounds, including morpholine, pyperidine, piperazine, and ethylene diamine. These amines are vaporized upon heating in the distillation column. They then condense on the upper portions of the condenser and distillation column where much of the corrosive damage occurs.

In a refinement of the above process, U.S. Patent 3,819,328, Go, adds the requirement of pH regulation. Under this process, pH control is achieved by use of alkylene polyamines, preferably ethylene diamine. By this method, the pH is adjusted to between 5.5 and 7.0 resulting in a minimization of corrosion on the acid side and fouling on the basic side.

DETAILED DESCRIPTION OF THE INVENTION

The present invention consists of a way to reduce the amount of $Na^+$ needed to effect a given reduction in HCl evolution without causing precipitation of $Mg(OH)_2$ or $CaCO_3$. It has been discovered that an effective chelating agent can prevent the generation of HCl. The chelant must be thermally stable at flash zone temperatures and of low oil solubility but high water solubility.

The chelant of the present invention, such as the commercially available $Na_3NTA$ (trisodium nitrilotriacetic acid), may be added to the hydrocarbon at any point in a petroleum refinery prior to the preheat unit. Ideally, however, addition would be between the desalter and the preheat unit. The chelant may be contained within a suitable carrier, such as an aqueous medium. It may be added continuously or shot fed into the hydrocarbon stream. All the above process parameters may be varied to provide for optimum usefulness under any given processing conditions.

Experiments have been conducted which prove that hydrolysis of $MgCl_2$ can be prevented or substantially reduced by the use of a chelant, trisodium nitrilotriace tic acid, $Na_3NTA$. The data shown in Table I were collected by steam distilling $MgCl_2$ alone or with either $Na_3$, NTA or NaOH. All runs were conducted at 245° C in a USP mineral oil; steam is passed through for not more than 30 minutes. Aqueous condensates were analyzed for $Cl^-$ by ion chromatography. The % hydrolysis was calculated from the $Cl^-$ concentration, the volume of aqueous condensate and the amount of $MgCl_2$. The less hydrolysis occurring, the more efficient the treatment.

TABLE I

| Test No. | Neutralizer | Molar Ratio (Neut:$Mg^{+2}$) | % Hydrolysis | Relative Moles $Na^+$ |
|---|---|---|---|---|
| 1 | None | — | 57.4 (15 mins) | — |
| 2 | None | — | 56.9 | — |
| 3 | None | — | 66.3 | — |
| 4 | None | — | 65.2 | — |
| 5 | NaOH | 1:1 | 25.5 | 1 |
| 6 | NaOH | 2:1 | 0.33 | 2 |
| 7 | $Na_3NTA$* | 0.25:1 | 11.7 | 0.75 |
| 8 | $Na_3NTA$* | 0.37:1 | 5.3 | 1.1 |
| 9 | $Na_3NTA$* | 0.75:1 | 6.9 | 2.3 |
| 10 | $Na_3NTA$* | 0.8:1 | 7.6 | 2.4 |
| 11 | $Na_3NTA$* | 1.6:1 | 0.04 | 4.8 |

*nitrilotriacetic acid, trisodium salt

Table I illustrates that the chelant is more efficient than caustic at suppressing hydrolysis (compare test numbers 5 and 7). Remarkably, this is achieved with less overall addition of free $Na^+$ to the system.

Field studies were conducted at two different full scale petroleum refineries. In Table II, the results of analyses at one refinery are shown. Only the conditions affecting the concentration of $Cl^-$ in the overhead condensing system are monitored.

TABLE II
REFINERY TRIAL I

| Neutralizer | Charge Rate MGPD | PTB as Na | Overhead ppm $Cl^-$ Baseline | Overhead $Cl^-$ Reduction ppm | % | Moles Na/ Mole $Cl^-$ |
|---|---|---|---|---|---|---|
| NaOH | 140 | 1.6 | 85 | 78 | 90 | 6.2 |
| NaOH | 140 | 0.85 | 85 | 61 | 72 | 3.6 |
| NaOH | 140 | 0.60 | 85 | 49 | 58 | 3.7 |
| $Na_3NTA$ | 140 | 1.6 | 84 | 42 | 50 | 12.0 |
| $Na_3NTA$ | 140 | 0.68 | 84 | 15 | 18 | 14.3 |

At the second refinery, overhead $Cl^-$ concentrations are monitored in addition to pH, organic acid levels and $HSO_3^-$ levels. Results are shown in Table III.

TABLE III
REFINERY TRIAL II

| Neutralizer (PTB as Na) | Day | Overhead $Cl^-$ Baseline | Overhead Reduction $Cl^-$ ppm | Moles Na/ Mole $Cl^-$ | Overhead pH | Overhead Organic Acids[1] | Overhead $HSO_3^-$ |
|---|---|---|---|---|---|---|---|
| None | 1 | 151 | — | — | 7.2 | 12 | 16 |
| NaOH(0.15) | 1 | 120 | 31 | 1.47 | 7.4 | 24 | 16 |
| $Na_3NTA$(0.35) | 1 | 91 | 60 | 1.79 | 7.3 | 8 | 10 |
| None | 2 | 114 | — | — | 8.0 | 11 | 16 |
| $Na_3NTA$(0.77) | 2 | 73 | 41 | 5.47 | 7.8 | 34 | 26 |
| $Na_3NTA$(0.34) | 2 | 102 | 12 | 8.14 | 8.0 | 22 | 24 |

[1]Numbers are chart units at an IC sensitivity of 10 $\mu$ s

The above data clearly indicates the sensitivity of the treatment program to varying system conditions. For example, the different efficiencies (mole $Na^+$/mole $Cl^-$) between Tables II and III may be due to the fact that more hydrolytically stable metals, were present in the crude being processed through the refinery used to provide the data for Table II. These metals may compete for the reaction sites on the chelant thereby allowing for fewer chelant/$Mg^{+2}$ reactions.

The chelant treatment program variations between the two days of analysis covered in Table III may be due to the varying quantities of different crude slates processed during that period of time. On day 1, the chelant was as efficient as caustic. On day 2, the efficiency of the chelant was greatly reduced. This is thought to have resulted from the addition of "condensate" to the crude slate. It is well known that each crude contains different concentrations of numerous constituents, such as hydrocarbon makeup and the concentrations of various salts, metals and other contaminants. The following shows the varying crude percentages both on the day before and then during the two day analysis at the refinery of Table III.

| Crude Slates | Day Before | Day 1 A.M. | Day 1 P.M. | Day 2 |
|---|---|---|---|---|
| Brent | 46% | 44% | 39% | 39% |
| Malango | 40% | 38% | 39% | 39% |
| ANS+Condensate [1] | 12% | 12% | 17% | 17% |
| CAT Feed | 2% | 6% | 6% | 6% |

[1]Alaskan North Slope+Algerian Condensate; however, no condensate charged until Day 1-P.M.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

1. A method of reducing the evolution of chloride ions generated in crude oil during processing in a petroleum refinery at elevated temperatures comprising adding to said crude oil a chelant comprising nitrilotria cetic acid or salt form thereof.

2. A method according to claim 1 wherein said chelant is added to said crude oil in said petroleum refinery prior to elevated temperature processing.

* * * * *